United States Patent [19]

Ruthström

[11] 4,389,916

[45] Jun. 28, 1983

[54] VIOLIN SUPPORT

[76] Inventor: Olof J. J. Ruthström, Djurgårdsvägen 144, S-115 21 Stockholm, Sweden

[21] Appl. No.: 232,045

[22] PCT Filed: May 13, 1980

[86] PCT No.: PCT/SE80/00139

§ 371 Date: Jan. 14, 1981

§ 102(e) Date: Jan. 14, 1981

[87] PCT Pub. No.: WO80/02617

PCT Pub. Date: Nov. 27, 1980

[30] Foreign Application Priority Data

May 14, 1979 [SE] Sweden ..... 7904223

[51] Int. Cl.[3] ..... G10G 5/00

[52] U.S. Cl. ..... 84/278; 84/280

[58] Field of Search ..... 84/278, 280, 281

[56] References Cited

U.S. PATENT DOCUMENTS

| | | | |
|---|---|---|---|
| 560,053 | 5/1896 | Strong | 84/278 |
| 1,199,685 | 9/1916 | Gaylord | 84/280 |
| 1,431,007 | 10/1922 | Kenne | 84/278 |
| 2,489,101 | 11/1949 | Mills | 84/280 |

OTHER PUBLICATIONS

Hampton: "Introduction to the Basic Mechanisms," U.S. Naval Institute, Annapolis, Md., p. 228, 1956.

*Primary Examiner*—Lawrence R. Franklin
*Attorney, Agent, or Firm*—Ladas & Parry

[57] ABSTRACT

Support for a string instrument belonging to the violin family which, when played upon, is kept in position between the jawbone and the collar bone with the aid of an anatomically well shaped chin rest (15) with a suitable protuberance (10), comprising a bow-member (1) contouring the human body, bendable, during playing in contact with three relative motionless spots on the players body, namely the collarbone, the chest about between the 2nd and 4th ribs about vertical below the chin tip and the Musculus Trapezius about between the 2nd and the 4th vertebra, between the back bone and the left shoulder blade; in the part which crosses the collar bone the bow-member supports a mounting plate (4) arranged to keep the violin in playing position with the assistance of details existing on the instrument; the stringholder cord (24), its saddle (21), and button (17) as well as in contact with the violin's rounded bottom edge (29); whereby the mounting-plate's upper part (23) has been given a shape which, when mounted to the violin and seen from the playing position points oblique rearwards, its wedge-shaped tongue (23) being situated between the stringholders cord (24) and the violin's side (28) in contact with the cord and simultaneously with its upper governing straight edge (11) in close contact with the stringholders saddle (21) thus wedged in place by the button (17), controls the violin's lateral heel, receives and transfers the necessary thrust in order to keep the violin in the playing position, from the chin, applied to the chin-rest (15) and its protuberation (10) to the bow-body whereby the mounting plate (4) with its lower flat part tangentially pushing against the bottom edge (29) supports with a force which counteracts the one excerted by the flap (23) and by the cord (24) thus also controls the violin's length axis.

3 Claims, 7 Drawing Figures

VIOLIN SUPPORT

TECHNICAL FIELD

The present invention refers to a support for string instruments belonging to the violin family which, when played upon, are kept in position between the jaw bone and the collar bone, suitably with the aid of an anatomically well shaped chin-rest with a suitable protuberance.

The need for an ergonomically designed violin support which can be adjusted to the player's body contour and length of neck, also usable with the larger viola and other instruments, is well known.

PRIOR ART

Violinists whose bodyshapes necessitate a support can often not find a really satisfying one. Some commercially available supports gradually cause injuries to the spinal column, its muscles and nerves due to their insufficence. Consequently, professionals, after long periods of working with more or less unsuitable modes of playing causing tensioned twisted necks and bent head-bearings, tend to be still more frequent cases for medical practitioners, orthopedes and neurologists all over the world.

Also, certain designs of supports have negative acoustic influences due to the vibration of the instrument created by their heaviness, unsuitable contact points with the instrument, e.g., springing hooks and/or strong rubber bands transmitting pressure upon the violin's "corpus" thus affecting an undesirable influence on the instrument's behaviour. Very often such known supports tend to fall off from the instrument.

Analysis of the anatomic functions when playing the violin as well as the mounting possibilities on the instrument have shown that only certain parts of the player's body as well as of the violin may be used to attach the support. By using said parts the left shoulder, arm and hand may be relieved from the burden of supporting the instrument in the playing position for the benefit of the physiologically complicated labor of playing. The violinist can thus be able to hold the instrument between the jawbone and the collarbone with an almost normal position of neck and head simultaneously, with minor disturbances affecting the vibrating instrument by attaching the support to its least vibrating spot with minimal contact surfaces.

THE INVENTION

The ergonomically designed violin support according to the invention is practical in use, may be bent to conform with the player's body, and adjusted to suit his neck as well as to the desired horizontal direction in relation to his body. Besides, its insignificant weight and slim dimensions permit it to be kept in the case close to the violin.

Figure 1A:
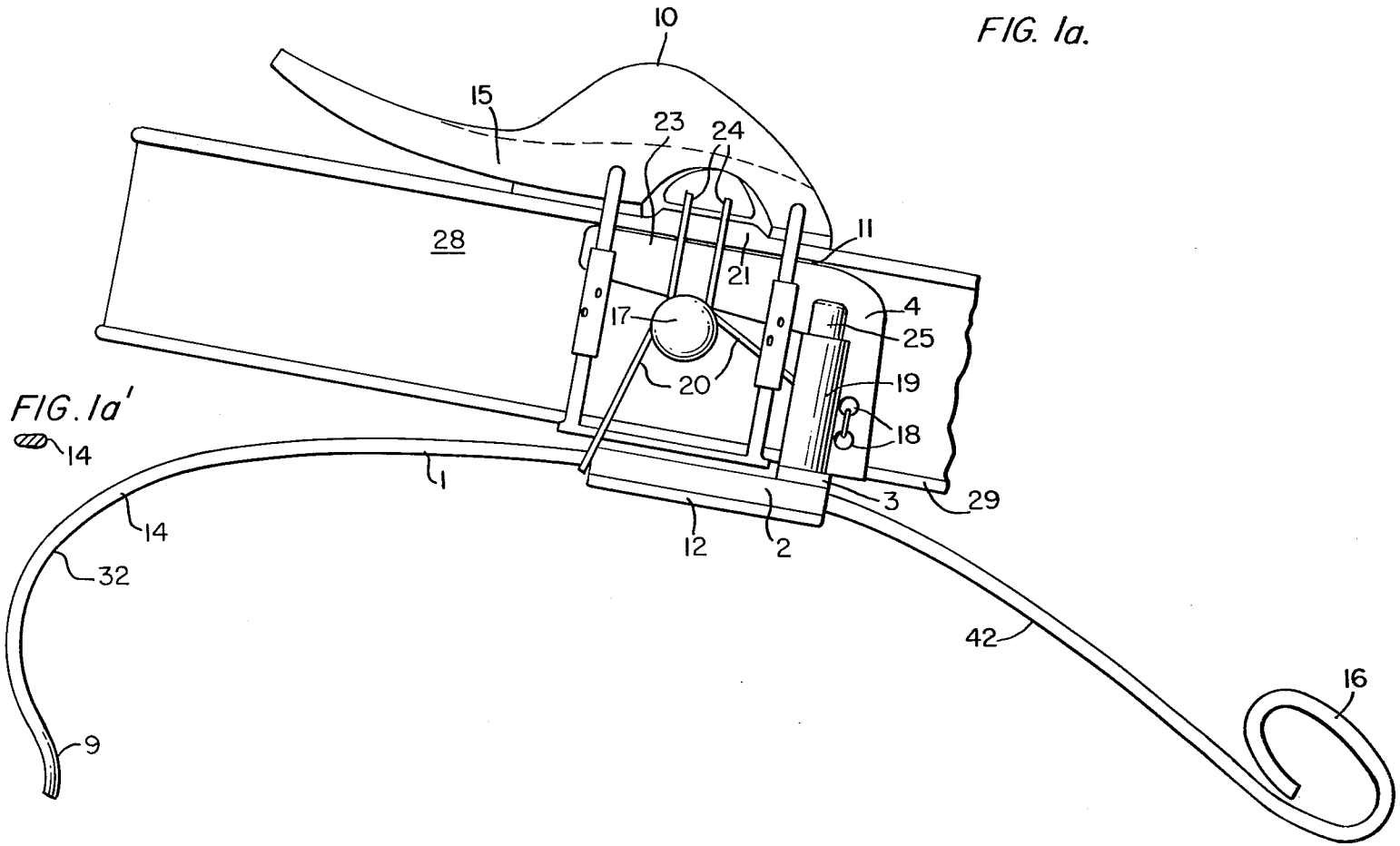
Figure 1B:
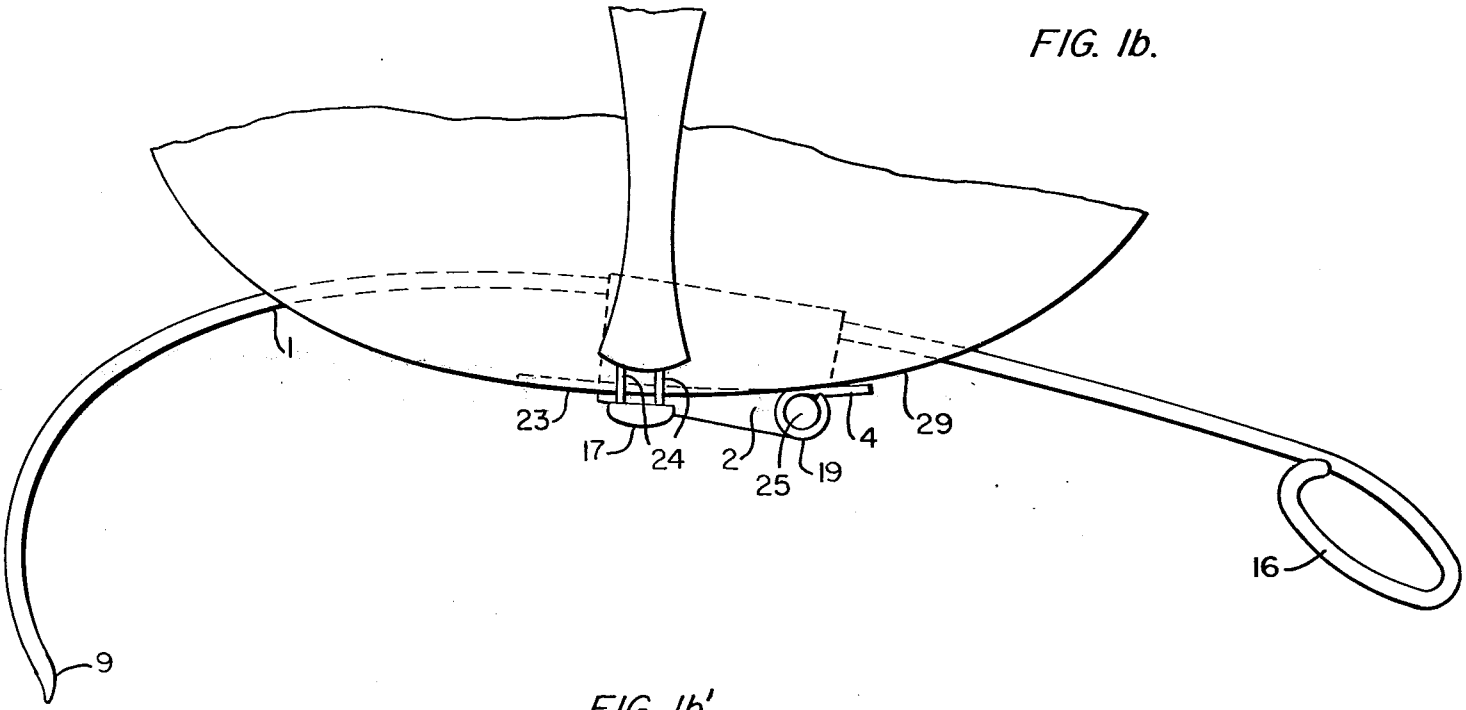
Figure 1B:
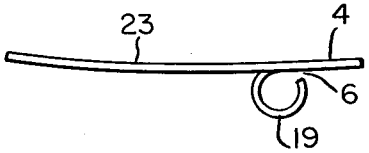
Figure 1C:
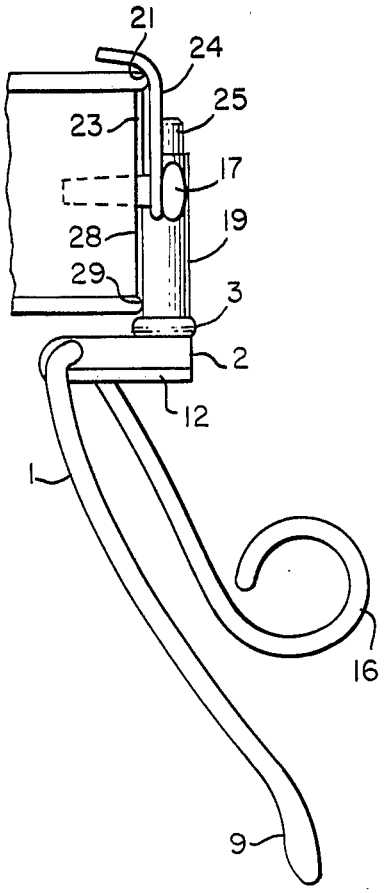
Figure 1D:
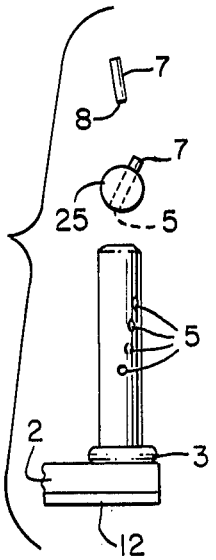
Figure 1E:
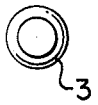
Figure 2A:
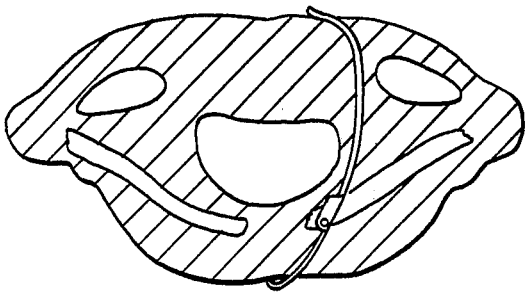
Figure 2B:
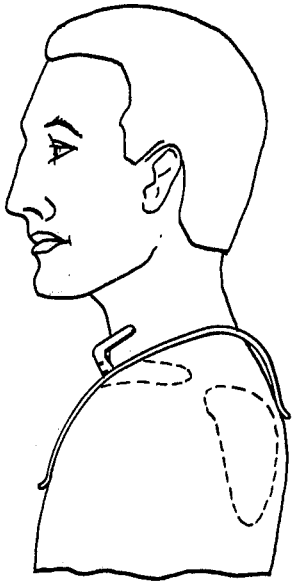
Figure 2C:
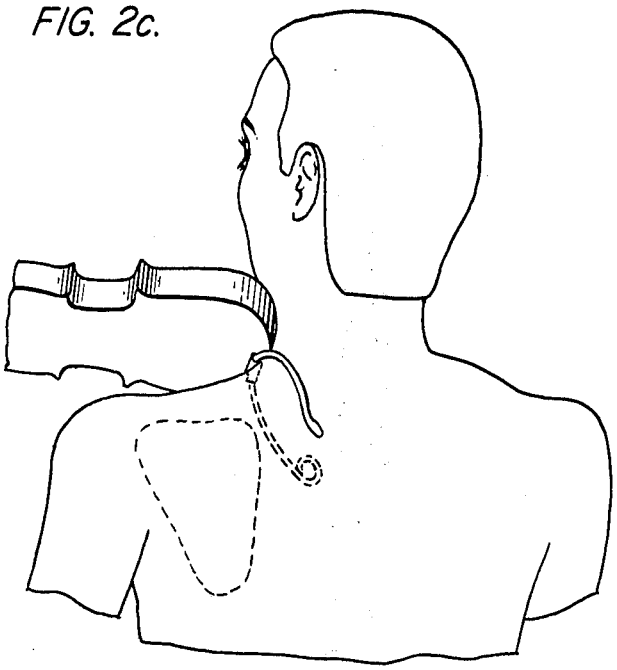
Figure 2D:
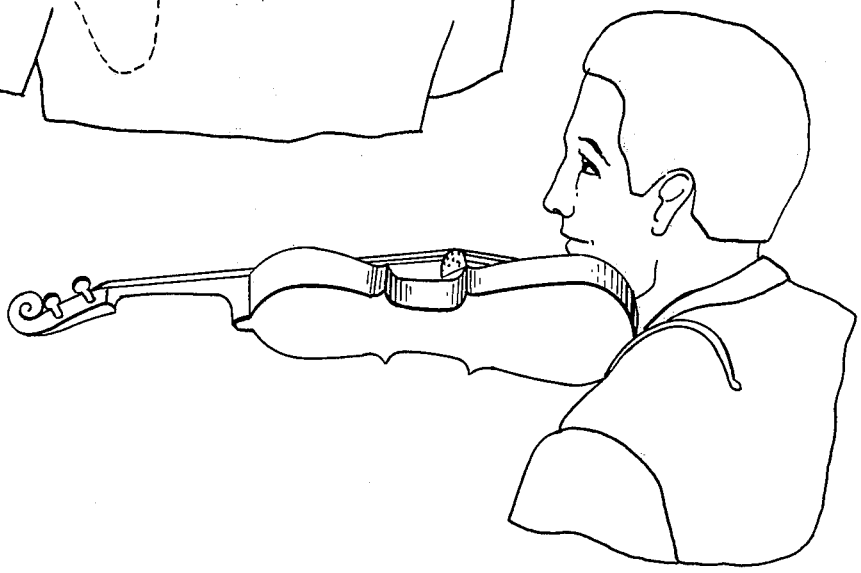

The basic idea of the invention will be described below with reference to the enclosed drawings which show a preferred embodiment of the support according to the invention. FIGS. 1*a, b, c* show the support mounted to the indicated instrument viewed from three positions with some details shown separately for the sake of clarity. The approximate location of the support on the human body is shown in FIG. 2 by an intersection (a) through the region of the shoulder blade, showing also the thorax and the collar bone, viewed from the side (b), from behind (c) and a view seen from behind-downwards (d).

The violin support in the Figs. consist of a bow member (1) bent mainly in a single curve to suit the contour of the human body, with a flat-oval cross-section (14), which with the instrument in playing position deviates at a suitable angle of about 45 degrees downwards from the indicated prolonged bottom-plane of the instrument, directed against the player where the bow shanks (32,42) straddles the player's chest and trapezoid muscle. The soft contoured rear shank-tip (9) rests at a point at the player's back (musculus trapezius) located between the 2nd and 4th vertebra and between the spinal column and the shoulder-blade. From this support-point the bow (1) almost contours the body to the collar bone (FIG. 2) against which the bow's projecting part (2), adjustable along the bow, rests, suitably covered with an elastic pad (12). This is the spot where the main load put on the chin-rest plus the load received from the center of gravity of the instrument due to the length of its moment-arm are imposed on the human "clamp," the chin-collar bone. In order to achieve the necessary stablization of the instrument the front-shank is extended downwards and rests, with a suitable foot on the chest, preferably between the 2nd and the 4th rib and about vertically below the chin-tip so as to rest upon three during the playing relatively unaffected spots of the body: the collar bone, the front part of the chest and the dorsal part of Musculus Trapezius.

The flexible support-bow (1) can be bent or twisted to suit the player's body. The projecting part (2) is adjustable along the bow and the mounting-plate (4) may be altered axially by means of distance-rings (3) in order to attain the best fit to the player's shape.

Outside of the violin's bottom contour the projecting member (2) is provided with a standing pivot (25), directed roughly perpendicularly to the violin's length and cross axis. On the pivot (25) an axially movable mounting plate (4) is hinged, the bent flap (19) of which embraces the pivot (25) so that a slot (6) between the edge of the flap and the flat area of the plate (4) is left open. Through optional holes (5) with slightly different radial directions, suitably perpendicularly to the pivot (25) and mutually of different suitable heights, a pin (7) of appropriate length is inserted in such a manner that its protruding end is guided in the slot (6). The mounting plate (4), which may be adjustable along the bow, has been given the shape of a trapezoidal tongue (23) which when attached to the instrument is inserted between the stringholder-cord (24) and the violin side (28) simultaneously with its upper straight edge (11) in contact with the stringholder-cords saddle (21) and wedged against the button (17), simultaneously in tangential contact with the cord and the edge (29) of the back of the violin. Thus, the pressure from the chin on the chinrest (15) and its cam (10) locks the violin in the playing position. The needed pressure imposed upon the chin-rest (15) and its cam (10) keeps the violin in the playing position.

The required pressure imposed on the chin rest is transmitted by the mounting plate (4) and the pivot (25) to the padded supporting part (12-2) to the collar bone. The inclination of this area requires the shank's (42) supporting foot (16) to rest against the chest as well as the shank's (32) supporting-foot (9) to rest on the dorsal area of musculus trapezius to give the instrument the necessary directional stability.

The bow (1) and the mounting plate (4) are tied together and secured to the violin by a suitable rubberband (20) or similarly lashed to plate (4) with the aid of the holes (18), the other end suitably being lashed to the bow (1) in proximity of the bows projecting part (2) and slung over the button (17).

The instrument will thus be kept in position along its three main axes and kept acoustically intact since only minimal moments or weights are transferred to the same. Thus, the player's left shoulder, arm and hand are totally free to cope with the difficult physiological functions which advanced violin playing demands without being troubled with the inconvenience of supporting the instrument.

Manufacturing the support by using, for example, a suitable aluminum alloy, and coating the support by the Eloxal or similar process will make the material compatible to the skin and to textiles. Surfaces in contact with the instrument will suitably be covered with hide or another suitable material.

The violin support may be changed in different ways without abandoning the fundamental principles.

I claim:

1. A support assembly for a string instrument of the violin family, said string instrument having a chin rest, a stringholder with a saddle, a stringholder cord and a button for securing the stringholder cord located on a side wall of the instrument which, when played upon, is kept in a position between a jaw bone and a collar bone, comprising:

(a) a bendable bow member adapted to be bent to conform to the player's body, said bow member having one end adapted to rest on the chest of the player and a second end adapted to rest on the back of the player;

(b) a support structure movably mounted on said bow member, said support structure adapted to be positioned on said bow member to rest on the collar bone of the player;

(c) a pivot part mounted on said support structure and extending upwardly therefrom transverse of the plane of the instrument body;

(d) a mounting plate having a wedge shaped part adapted to be positioned between said stringholder cord and said side wall in the horizontal direction and between said button and said saddle in the vertical direction, said mounting plate having a means connected thereto for receiving said pivot part;

(e) said pivot part and said receiving means including adjustable means for constraining pivotal movement therebetween; and (f) flexible means for removably securing said mounting plate and said bow member together.

2. The support assembly as defined in claim 1 wherein said adjustable means comprises a plurality of radial apertures extending perpendicularly through said pivot part in slightly different radial directions, a slot extending longitudinally through said receiving means, and a pin adapted to be placed in one of said apertures while extending through said slot.

3. The support assembly of claim 1 wherein said flexible means is a rubber cord.

* * * * *